US008430723B2

(12) United States Patent
Moon

(10) Patent No.: US 8,430,723 B2
(45) Date of Patent: Apr. 30, 2013

(54) CONTOUR GUIDE FOR ICE SKATE SHARPENER

(75) Inventor: Robert Moon, Chatham (CA)

(73) Assignee: Guspro Inc., Chatham (CA)

( * ) Notice: Subject to any disclaimer, the term of this patent is extended or adjusted under 35 U.S.C. 154(b) by 380 days.

(21) Appl. No.: 12/766,573

(22) Filed: Apr. 23, 2010

(65) Prior Publication Data

US 2010/0273403 A1 Oct. 28, 2010

Related U.S. Application Data

(60) Provisional application No. 61/172,061, filed on Apr. 23, 2009.

(51) Int. Cl.
*B24B 7/00* (2006.01)

(52) U.S. Cl.
USPC ..... 451/281; 451/45; 451/205; 451/383; 451/202

(58) Field of Classification Search ..... 451/281, 451/202, 45, 205, 383, 404, 419
See application file for complete search history.

(56) References Cited

U.S. PATENT DOCUMENTS

| | | | | | |
|---|---|---|---|---|---|
| 986,501 | A | * | 3/1911 | Roberts | 451/383 |
| 1,175,702 | A | * | 3/1916 | Busier | 451/226 |
| 1,213,609 | A | * | 1/1917 | Ferodowill | 451/383 |
| 3,789,551 | A | * | 2/1974 | Norris et al. | 451/28 |
| 4,078,337 | A | * | 3/1978 | Chiasson et al. | 451/303 |
| 4,109,419 | A | * | 8/1978 | Broadbent | 451/216 |
| 4,139,209 | A | * | 2/1979 | Humphreys | 280/11.12 |
| 4,172,343 | A | * | 10/1979 | Sakcriska | 451/45 |
| 4,294,043 | A | | 10/1981 | Sakcriska | |
| 4,355,557 | A | * | 10/1982 | Mecsey | 83/565 |
| 4,392,658 | A | | 7/1983 | Redmond et al. | |
| 4,403,455 | A | * | 9/1983 | Chiasson | 451/303 |
| 4,615,144 | A | | 10/1986 | Peacock et al. | |

(Continued)

FOREIGN PATENT DOCUMENTS

| | | | |
|---|---|---|---|
| CA | 2083434 | A1 | 5/1994 |
| WO | WO 00/67949 | A1 | 11/2000 |

OTHER PUBLICATIONS

Epinions.com—Posts in Skate sharpening machines?; http://www.epinions.com/msg/sec_~forums/show_~threads/cat_id_~28/id_~6074/forum_id_~316/pp_~1/pa_~1#posts.

(Continued)

*Primary Examiner* — George Nguyen
(74) *Attorney, Agent, or Firm* — John R. S. Orange; Blake, Cassels & Graydon LLP

(57) ABSTRACT

A guide assembly for an ice skate sharpener cooperates with a template of a desired contour of a skate blade to control the relative disposition of a sharpening wheel and a skate blade. The guide assembly comprises a base and a carriage slidably mounted on the base so as to be moveable, relative to said base, along a predefined path. A support is provided for connection to a skateholder. The support is connected to the carriage to permit movement of a skateholder in a direction normal to the path. The support inhibits relative movement between the carriage and a skateholder in a direction parallel to said path. A follower connected between the skateholder and template, control movement of the skateholder in a direction normal to the path as the carriage is moved along said predefined path. The skateholder therefore follow the contour of the template.

19 Claims, 6 Drawing Sheets

U.S. PATENT DOCUMENTS

| | | | | |
|---|---|---|---|---|
| 4,669,166 | A | 6/1987 | Grimes | |
| 5,354,078 | A | 10/1994 | BelleIsle | |
| 5,897,428 | A * | 4/1999 | Sakcriska | 451/202 |
| 6,116,989 | A | 9/2000 | Balastik | |
| 6,422,934 | B1 | 7/2002 | Blach et al. | |
| 6,619,674 | B2 | 9/2003 | Baldwin | |
| 7,473,164 | B2 | 1/2009 | Sunnen | |
| 2002/0058467 | A1 * | 5/2002 | Blanton | 451/45 |
| 2008/0280548 | A1 | 11/2008 | Wilson et al. | |
| 2009/0004956 | A1 * | 1/2009 | Smith | 451/371 |
| 2009/0273149 | A1 | 11/2009 | Wilson et al. | |

OTHER PUBLICATIONS

Broadbent, S.; "How we started, what we've done since 1977 and what we're doing now"; www.iceskateology.com/Skateology/ABOUT_US_.html; Jan. 2008/Sep. 2009.

* cited by examiner

CONTOUR GUIDE FOR ICE SKATE SHARPENER

CROSS REFERENCE TO RELATED APPLICATIONS

This application claims priority from U.S. Provisional Application No. 61/172,061 filed on Apr. 23, 2009; the contents of which are incorporated herein by reference.

FIELD OF THE INVENTION

The present invention relates to a guide for use with an ice skate sharpener.

SUMMARY OF THE INVENTION

The blades of an ice skate need to be frequently sharpened in order to maintain optimum performance. The sharpening is normally done by passing the blade past a grinding wheel and must be done with great precision. The blade edge will have a transverse concave profile to provide a pair of laterally spaced edges. The cross section of the profile is determined by the shape of the grinding wheel and must be aligned with the centre line of the blade itself to provide edges at the same height. Moreover, the blade has a contour along its length so that the lower edge of the blade is radiused from tip to heel. The contour of the blade will vary according to the type of skating that is to be performed, with speed skates having an essentially linear contour away from the toe and hockey skates having a more radiused contour along the entire length.

In order to provide the necessary precision, the skate is normally mounted in a skate holder that presents the blade to the grinding wheel in a stable precise manner. The holder is mounted on a table top and may be slid along the table top past the wheel in order to grind the profile on the blade of the skate. With proper adjustment of the holder, this arrangement ensures that the profile is centred on the centre line of the blade. However, the matching of the contour from toe to heel still requires physical dexterity to ensure that an even, uniform cut is made by the grinding wheel.

To alleviate the difficulties associated with this, it is also known to mount the skate holder to a contouring attachment that guides the skate holder along a predetermined path past the wheel. The known guides utilize a template that mimics the required contour of the blade. The guide has a pair of wheels that are longitudinally spaced and bear against the template. This controls movement of the blade relative to the grinding wheel as the skate is slid past the wheel. Whilst this arrangement ensures a more consistent profile, the provision of the pair of wheels results in only an approximation of the required contour due to the need to space the wheels apart for the requisite stability. As such, accurate grinding of the contour cannot be achieved.

It is therefore an object of the present invention to provide a guide for a skate holder in which the above disadvantages are obviated or mitigated.

In general terms, the present invention provides a guide assembly for an ice skate sharpener, said guide assembly cooperating with a template of a desired contour of a skate blade to control the relative disposition of a sharpening wheel and a skate blade, said guide assembly comprising a base and a carriage, slidably mounted on said base so as to be moveable, relative to said base, along a predefined path, a support for connection to a skateholder, said support being connected to said carriage to permit movement of a skateholder connected thereto in a direction normal to said path while inhibitly relative movement between said carriage and a skateholder in a direction parallel to said path, a follower to be connected between said skateholder and a template, said follower controlling movement of said skateholder in a direction normal to said path as said carriage is moved along said predefined path and thereby cause said skateholder to follow the contour of said template.

BRIEF DESCRIPTION OF THE DRAWINGS

An embodiment of the invention will now be described by way of example only with reference to the accompanying drawings in which.

DETAILED DESCRIPTION OF THE INVENTION

Figure 1:
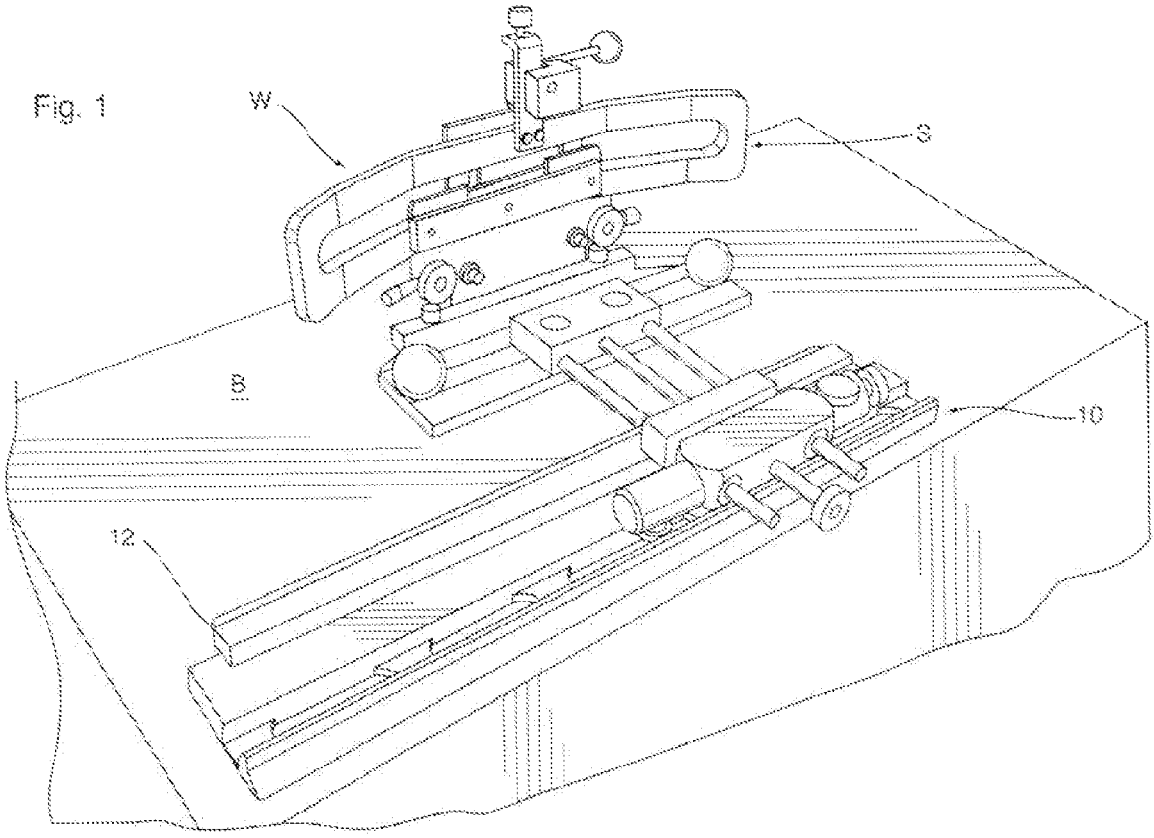
FIG. 1 is a perspective view of a skate sharpening station.
Figure 2:
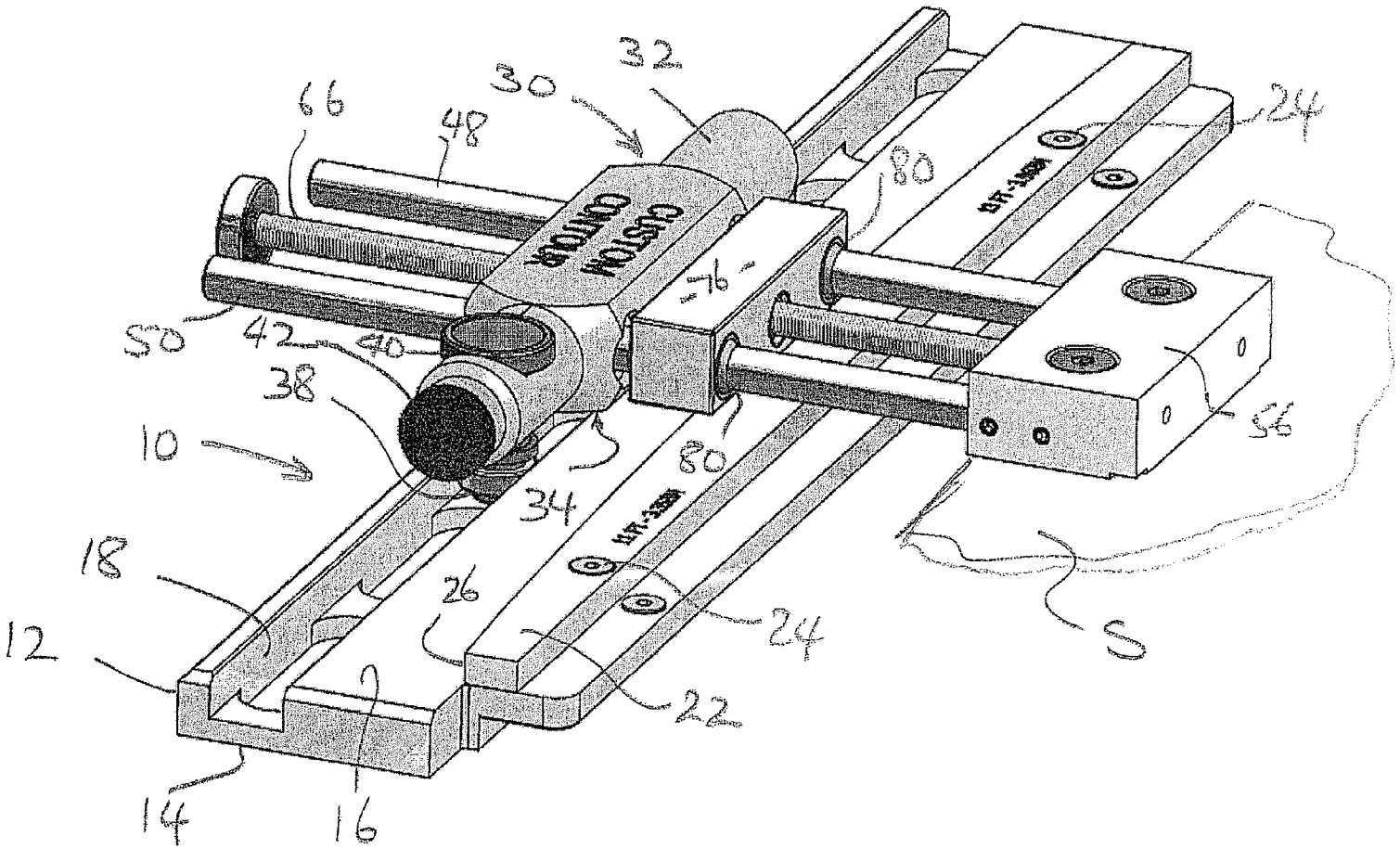
FIG. 2 is a perspective view of a guide.
Figure 3:
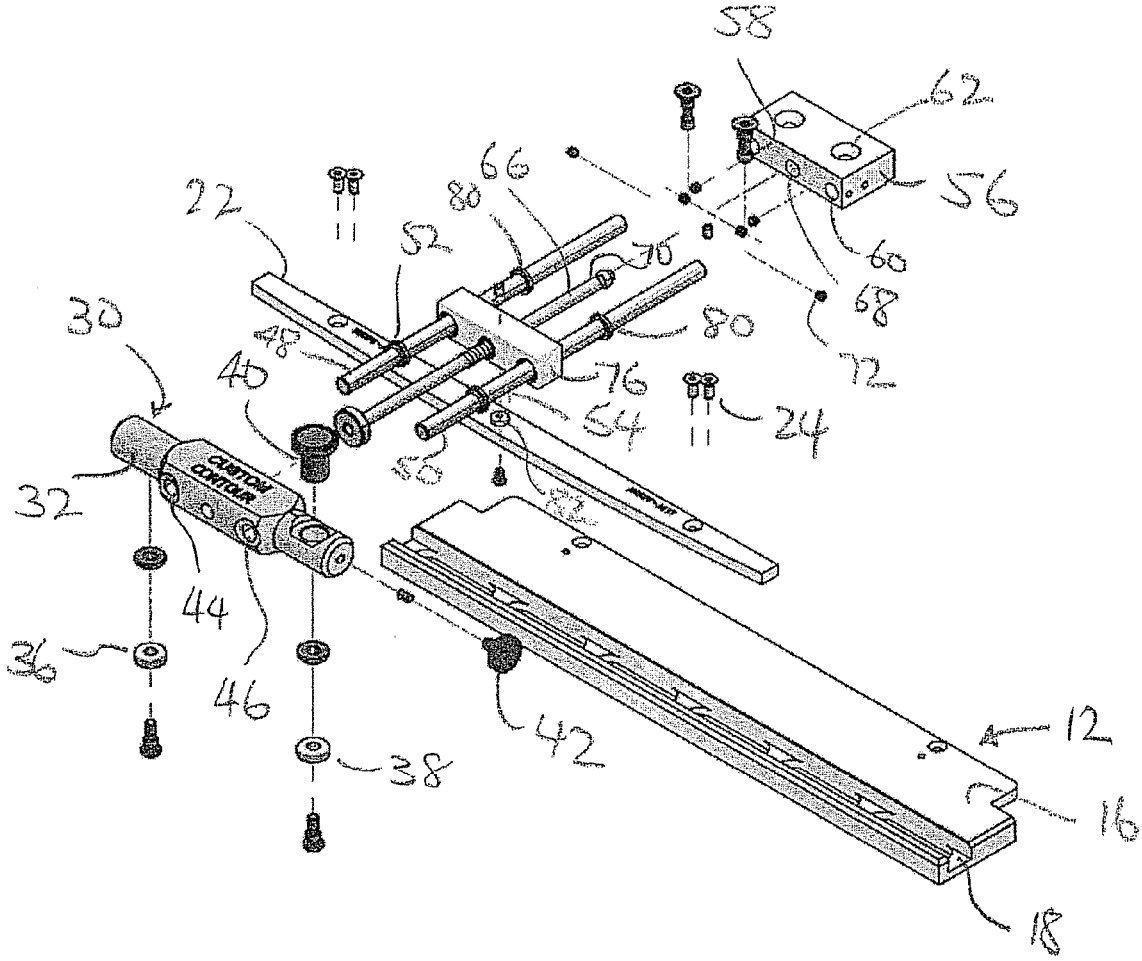
FIG. 3 is an exploded view showing the components of the guide of FIG. 2.
Figure 4:
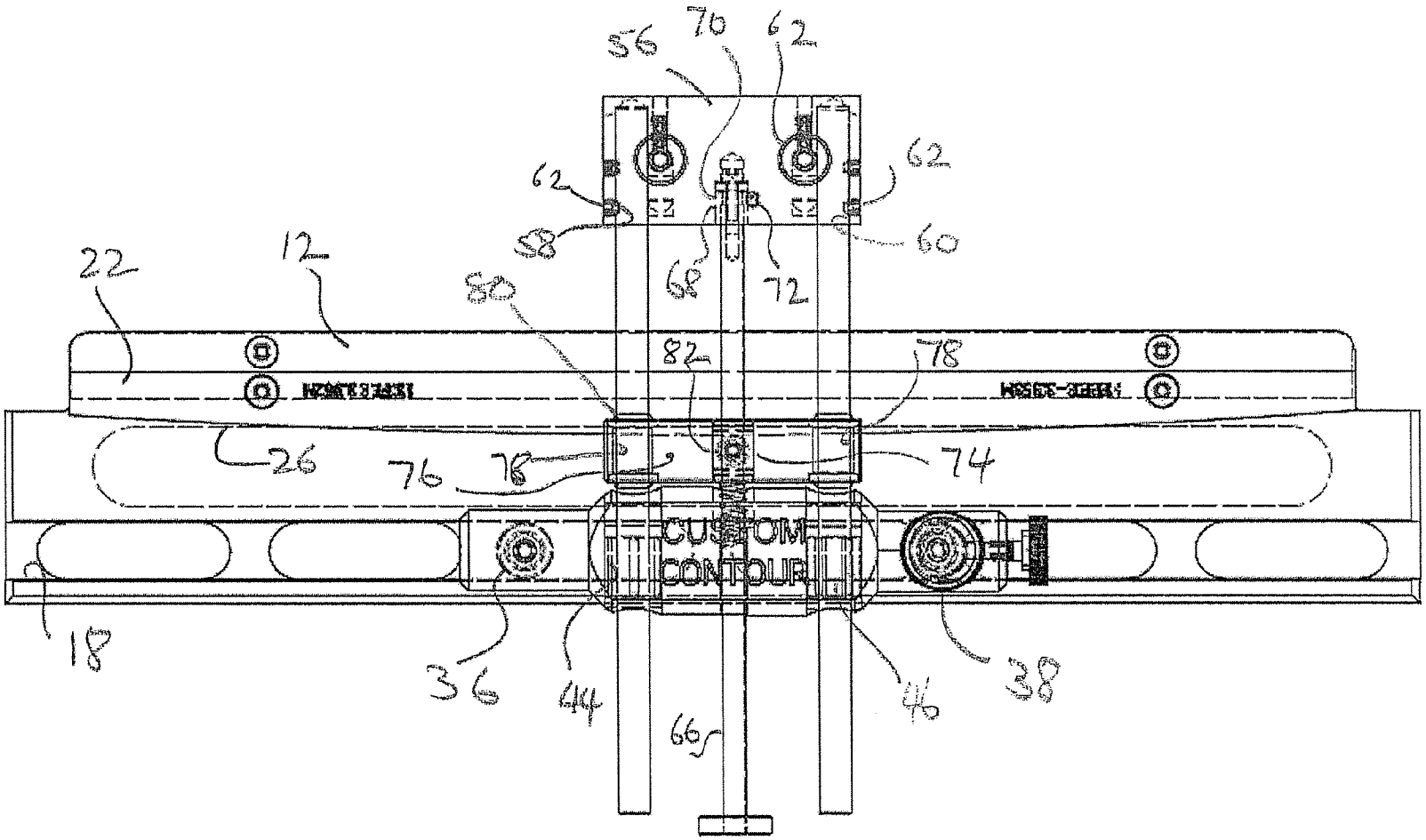
FIG. 4 is a plan view of the guide of FIG. 2.
Figure 5:
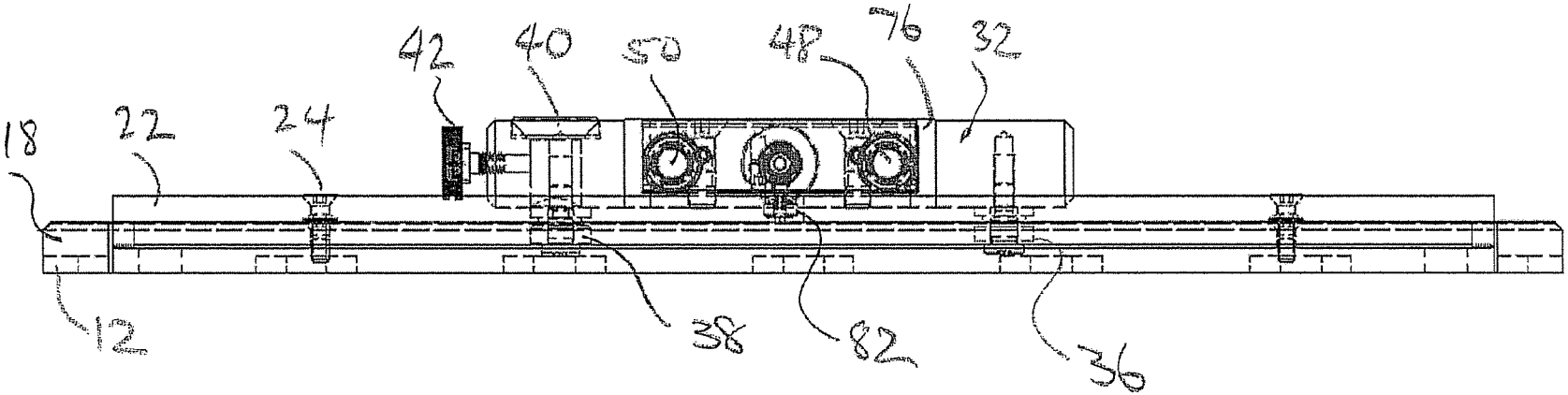
FIG. 5 is a front elevation of the guide of FIG. 2.
Figure 6:
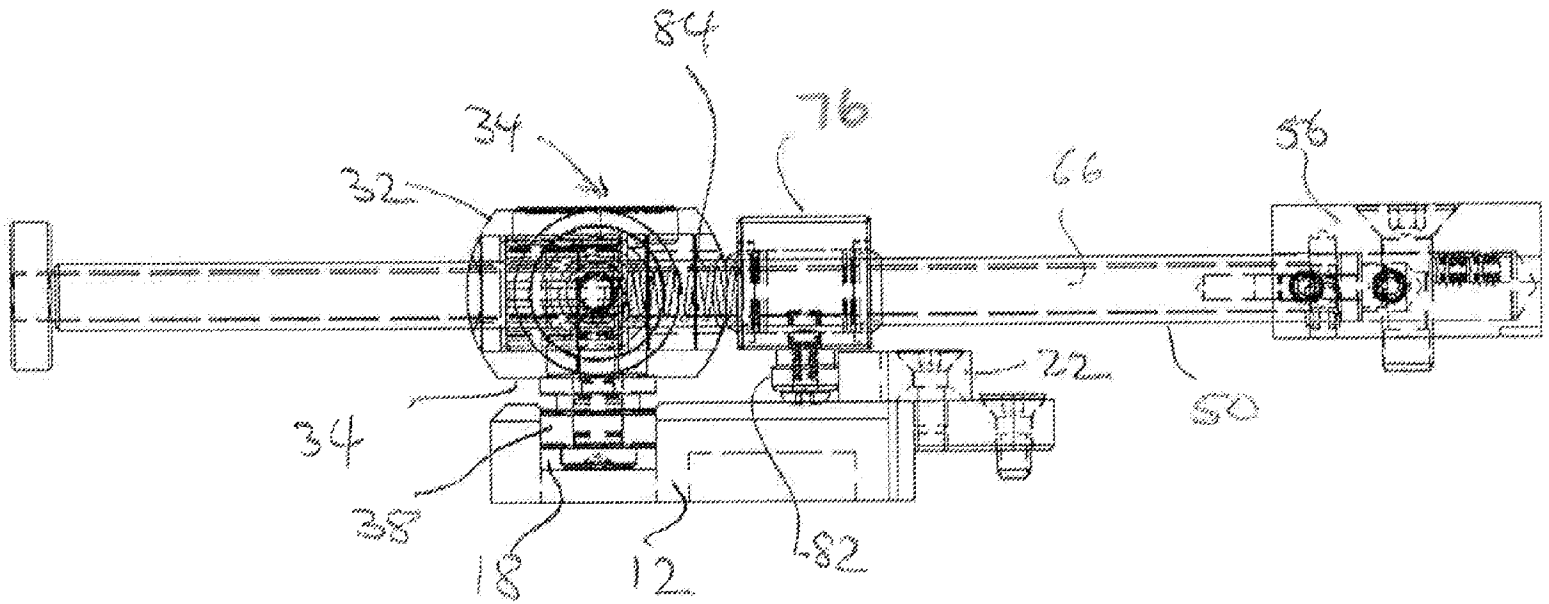
FIG. 6 is a end view of the guide of FIG. 2.

Referring therefore to FIG. 1, a guide assembly generally indicated at 10 has a base 12 with a lower surface 14 designed to slide along a bench indicated generally at (B). The guide assembly 10 is connected to a skate holder (S) which is also designed to slide on the bench (B). The form of skate holder may vary but a particularly suitable skate holder is one shown in US Pat. No. 7,473,164 the contents of which are incorporated herein by reference.

It will be appreciated that the skate holder (S) is designed to support a skate and present the edge of the blade to a grinding wheel (W) that is fixed relative to the bench (B) and rotates about a horizontal axis (as shown) on a vertical axis. The base 12 has an upper surface 16 with an elongate linear groove 18 formed adjacent a front edge 20. The vertical faces defining the groove 18 providing abutment faces that define a predetermined path. The upper surface 16 has a template 22 that is removably secured to the upper surface 16 through set screws 24. The template 22 has a guide edge 26 directed forwardly and having a contour corresponding to the desired contour of the skate blade. The template may be removed and replaced with a alternate template to match the contour to the particular skates being ground.

A carriage 30 has a body 32 with an under surface 34 that slides across the upper surface 16 of the base 12. The carriage 30 is guided by guide wheels 36, 38 that are rotatably mounted on the under surface 34 and body 32 and snugly received in the groove 18 so that the rolling of the wheels on the abutment faces constrains the carriage to move along the predetermined path. The guide wheels 36, 38 are spaced apart at opposite ends of the body 32 to inhibit rotation about a vertical axis between the carriage 30 and the base 12. The wheel 38 is mounted in an eccentric bushing 40 that is rotatable to provide fine adjustment of the alignment of the carriage 30 and the groove 18. This permits the lie, or angle of the edge, of the blade to be adjusted, e.g. to suit the position played by a hockey player. The bushing 40 is locked by a clamping screw 42.

The body 32 has a pair of transverse bores 44, 46 that slidably receive a pair of support rods 48, 50. The rods 48, 50 are a smooth sliding fit on bearings within the bores 44, 46 and a sealing ring 52, 54 is mounted on the rods to prevent grinding dust or the like being carried by the rods into bores. The rods 48, 50 extend to a connecting block 56 where they are received in bores 58, 60. The rods 48, 50 are secured in the bores 58, 60 by set screws 62. The connecting block 56 is drilled, as indicated at 62, to receive connecting screws 64 to connect the block 56 to the skate holder (S).

A threaded rod 66 is mounted in a central hole 68 in the connecting block 56 and is freely rotatable within the hole. The threaded rod 66 has a circumferential groove 70 formed at its inner end and a retaining screw 72 secures the rod 66 to the connecting block 56. The threaded rod 66 is received in a through bore 74 in block 76 the bore 74 is threaded to engage with the threaded rod 66 so that rotation of the rod 66 adjusts the relative position between the rod 66 and the follower block 76. The block 76 has a pair of outer apertures 78 that are dimensioned to slidingly receive the support rods 48, 50. Seals 80 are provided to inhibit the passage of grinding dust into the aperture 78 on the rods 48, 50.

A following wheel 82 is mounted on the underside of the follower block 76 and positioned so as to engage the guide edge 26 of the template 22 when the carriage 30 is engaged with the upper surface 16. The following wheel 82 is rotatable about an axis orthogonal to the axis of the threaded rod 66 and aligned with the rod. A compression spring 84 is located on the rod 66 between the body 32 and the follower block 76 to bias them apart.

In operation, the base 12 is mounted to the bench (B) either in a permanent manner through screws or by clamping to the bench. The connecting block 56 is attached to the blade holder and an initial adjustment of the relative spacing between the follower blocks 76 and the connecting block 56 is made by rotating the threaded rod 66. The spacing in between the blocks is adjusted so that the blade edge engages the grinding wheel when the following wheel 82 is engaged with the guide edge 26 of the template 22.

The carriage 30 is then placed on the upper surface 16 with the guide wheels 36 engaged with the groove 18. The spring 84 acts between the body 32 and the follower block 76 to force the following wheel 82 against the guide edge 26. The rods 48, 50 are free to slide relative to the follower block 76 and the body 32 so that the positioning of the connecting block and therefore the blade holder is determined by the setting on the threaded rod 66. The lie of the blade can be adjusted with the bushing 40 and locked.

With the correct adjustments made, the blade holder (S) is slid along the bench (B) to move the blade past the grinding wheel. As the blade holder is slid, the carriage 30 maintains the skate holder (S) parallel to the groove 18 and inhibits pivotal movement about a vertical axis. The guide edge 26 acts on the follower wheel 82 to move the skate holder fore and aft relative to the grinding wheel as the carriage slides along the groove 18. The distance between the follower block and the connecting block is fixed by the threaded rod 66 so that the connecting block mimics the contour of the guide edge 26. The rods 48, 50 however maintain the stability of the skate holder as it is moved past the grinding wheel.

After an initial pass, rotation of the threaded rod 64 moves the connecting block 56 away from the follower block 76 by a small increment and allows a further pass to be made following the same contour. This process is repeated until the skate edge is properly dressed to the satisfaction of the machinist.

Where an alternate contour is required on the skate, the template 22 is simply removed by removal of the set screws 24 and replaced with a template of the appropriate contour.

It will be seen that the connection between the follower block and the template is at a single point allowing accurate translation of the skate holder (S) relative to the grinding wheel. However, the provision of the sliding carriage and rods 48, 50 ensures stability about a vertical axis and therefore accurate grinding of the blade.

The invention claimed is:

1. A guide assembly for an ice skate sharpener, said guide assembly cooperating with a template of a desired contour of a skate blade to control the relative disposition of a sharpening wheel and a skate blade. said guide assembly comprising a base, a carnage slidably mounted on said base so as to be moveable, relative to said base, along a predefined path, a support for connection to a skateholder, said support being connected to said carriage to permit movement of a skateholder connected to said carriage in a direction normal to said predefined path while inhibiting relative movement between said carriage and a skateholder in a direction parallel to predefined said path and a follower to be connected between said skateholder and said template, said follower controlling movement of said skateholder in a direction normal to said path as said carriage is moved along said predefined path and thereby cause said skateholder to follow the contour of said template.

2. A guide assembly according to claim 1 wherein said follower is adjustable to vary the spacing between a skateholder and said template.

3. A guide assembly according to claim 2 wherein said follower engages said template at a single contact point.

4. A guide assembly according to claim 3 wherein said follower includes a wheel to roll along said template.

5. A guide assembly according to claim 2 wherein said follower is supported on said supports.

6. A guide assembly according to claim 1 wherein said predefined path is linear.

7. A guide assembly according to claim 6 wherein said base has a linear abutment face defining said path and said carriage has wheels engaging said face to guide said carriage along said path.

8. A guide assembly according to claim 7 wherein said base has a linear groove having opposed abutment faces and said wheels are received in said groove for movement along said path.

9. A guide assembly according to claim 7 wherein said wheels are spaced apart along said path.

10. A guide assembly according to claim 7 wherein said support comprises at least one support rod slidably mounted on said carriage for movement in a direction normal to said path.

11. A guide assembly according to claim 10 wherein said support comprises a pair of support rods slidably mounted at spaced locations on said carriage.

12. A guide assembly according to claim 11 wherein said follower includes a follower block slidably supported on said support rods and a follower rod mounted on to said follower block for connection to said skate holder.

13. A guide assembly according to claim 12 wherein a follower wheel is mounted on said follower block for engagement with said template.

14. A guide assembly according to claim 13 wherein the position of said follower block on said follower rod is adjustable to vary the spacing between the skateholder and template.

15. A guide assembly according to claim 14 wherein said follower rod is threaded in to said follower block and rotation of said follower rod adjusts said follower block on said follower rod.

16. A guide assembly according to claim 14 wherein a spring is located between said carriage and said follower block said follower block in to engagement with said template where said carnage is in abutment with said abutment face.

17. An ice skate sharpener comprising a base, a template of a desired contour of a skate blade mounted on said base, said template controlling the relative disposition of a sharpening wheel and a skate blade, a carriage, slidably mounted on said base so as to be moveable, relative to said base, along a predefined path, a support connected to a skateholder, said support being connected to said carriage to permit movement of said skateholder connected thereto in a direction normal to said path while inhibitly relative movement between said carriage and said skateholder in a direction parallel to said path, a follower to be connected between said skateholder and a template, said follower controlling movement of said skateholder in a direction normal to said path as said carriage is moved aong said predefined path and thereby cause said skateholder to follow the contour of said template.

18. An ice skate sharpener according to claim 17 wherein said support includes a pair of support rods connected at one end to said skateholder and slidable relative to said carriage in a direction normal to said path.

19. An ice skate sharpener according to claim 18 wherein said follower includes a follower block supported in said support rods, a follower rod connected to said skateholder and adjustably mounted in said block, and a wheel on said block to engage said template and control movement of said skateholder relative to said carriage.

* * * * *